US006209452B1

(12) United States Patent
Klimek

(10) Patent No.: US 6,209,452 B1
(45) Date of Patent: Apr. 3, 2001

(54) GOLF BALL MARKING TEMPLATE

(75) Inventor: Edward A. Klimek, 21020 134th Way, Sun City West, AZ (US) 85375

(73) Assignee: Edward A. Klimek, Sun City West, AZ (US)

( * ) Notice: Subject to any disclaimer, the term of this patent is extended or adjusted under 35 U.S.C. 154(b) by 0 days.

(21) Appl. No.: 09/324,536

(22) Filed: Jun. 2, 1999

(51) Int. Cl.[7] ..... B41F 17/30; B05C 17/06
(52) U.S. Cl. ..... 101/35; 101/27; 101/DIG. 40
(58) Field of Search ..... 101/35, DIG. 40, 101/114, 127, 129

(56) References Cited

U.S. PATENT DOCUMENTS

| | | | | |
|---|---|---|---|---|
| 676,506 | | 6/1901 | Knight et al. | 473/268 |
| 734,085 | * | 7/1903 | O'Mara et al. | 101/114 |
| 751,145 | * | 2/1904 | Burt | 101/114 |
| 952,501 | | 3/1910 | Blumberg | 101/35 |
| 1,167,727 | | 1/1916 | Stevens | 101/4 |
| 1,537,685 | | 5/1925 | Ladd | 101/4 |
| 1,646,021 | * | 10/1927 | Grosser | 101/35 |
| 1,814,170 | | 7/1931 | Long | 101/35 |
| 2,541,358 | | 2/1951 | Hirsch | 101/4 |
| 2,561,947 | | 7/1951 | Premo | 101/41 |
| 3,019,762 | | 2/1962 | Hautz | 118/76 |
| 4,546,644 | | 10/1985 | Beny et al. | 73/65 |
| 5,542,680 | | 8/1996 | Proudfit et al. | 473/378 |
| 5,925,186 | * | 7/1999 | Klimek | 101/35 |

* cited by examiner

*Primary Examiner*—John S. Hilten
*Assistant Examiner*—Leslie J. Grohusky

(57) ABSTRACT

The present invention is a ball marking template comprising first and second portions attached to each other at first ends respectively by a hinge mechanism, the first and second portions each further having two inwardly curving arms separated by a gap on second ends thereof, whereby when a golf ball is placed within the template, it may be marked by tracing along a peripheral edge of the gap. In an alternate embodiment, the ball marking template comprises first and second portions attached to each other by a curved portion, each of the first and second portions having a shaped aperture located at a distal end, respectively, whereby when a golf ball is placed within the template, it may be marked by tracing along a peripheral edge of the apertures. In another alternate embodiment, the ball marking template comprising first and second portions attached to each other at first ends respectively by a hinge mechanism, the first and second portions both have a concave inner face and each further having a peripheral edge, whereby when a golf ball is placed within the template, it may be marked by tracing along the peripheral edge of the first and second portions.

10 Claims, 7 Drawing Sheets

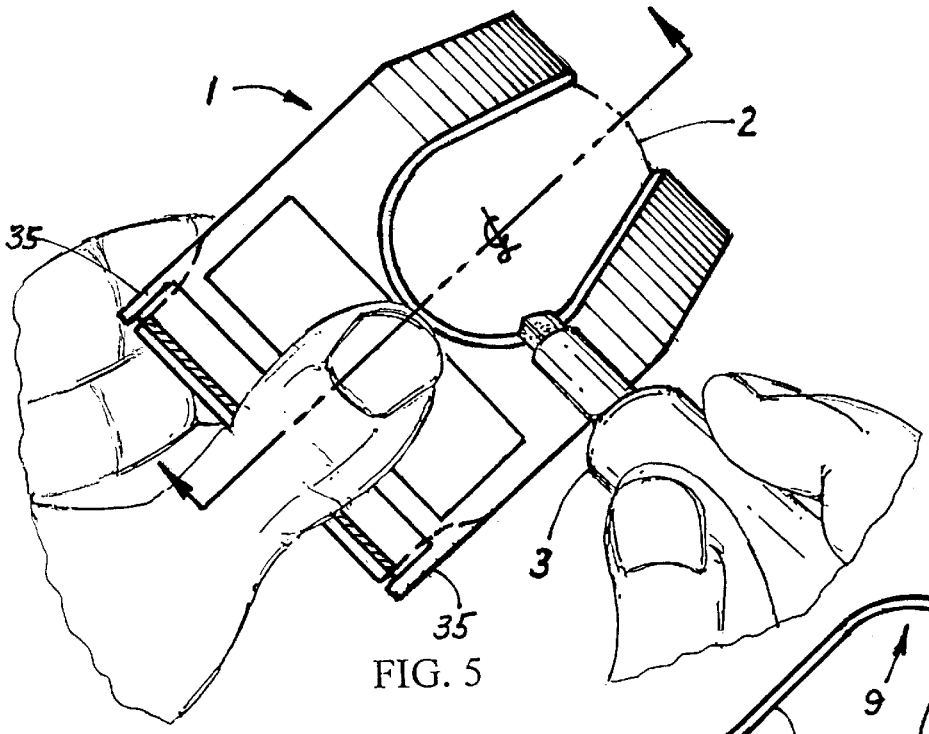
FIG. 5
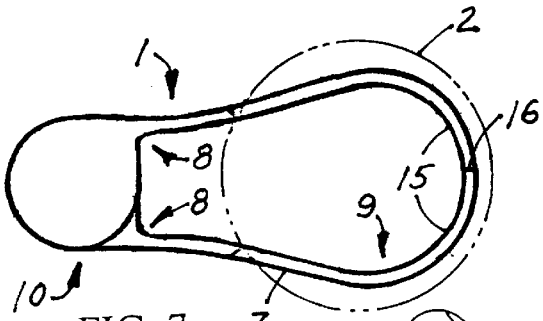
FIG. 7
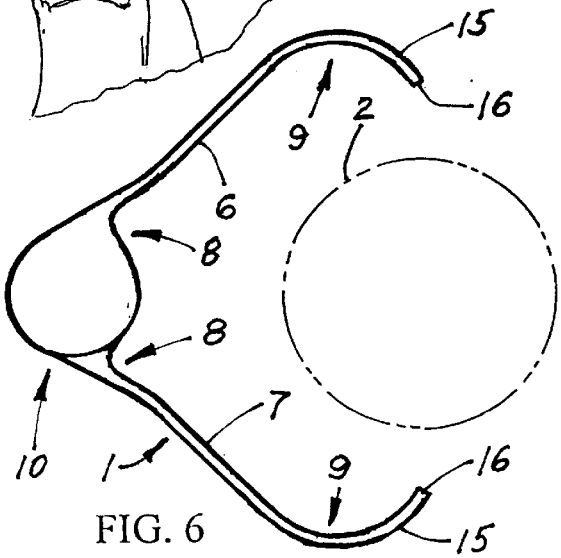
FIG. 6
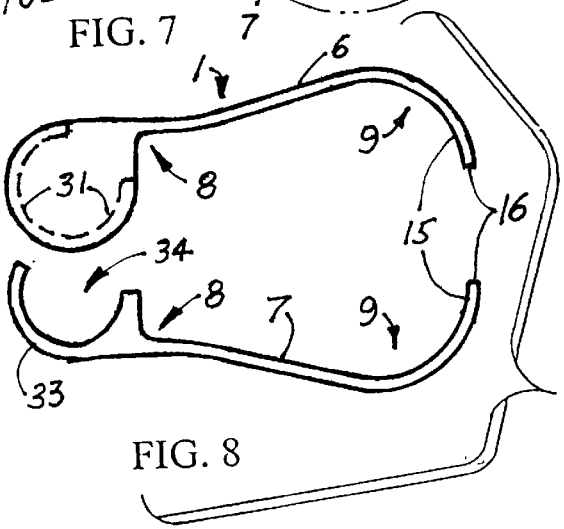
FIG. 8
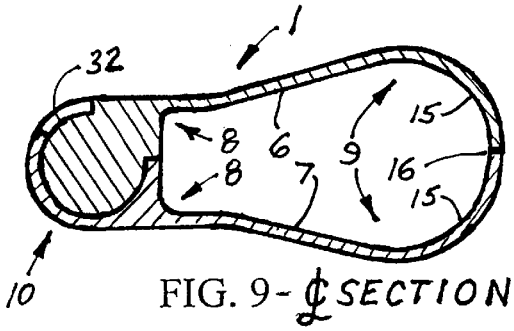
FIG. 9- ℄ SECTION

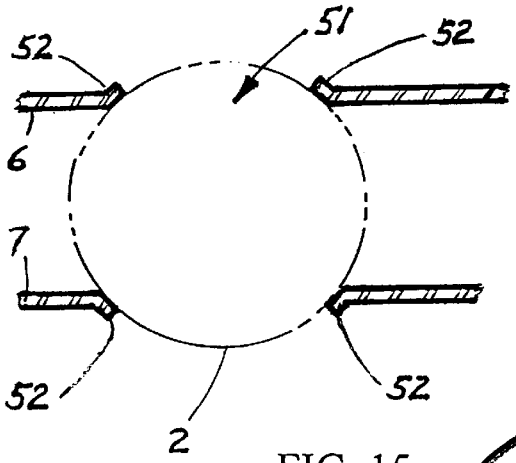
FIG. 14 SECTION I-I
FIG. 15
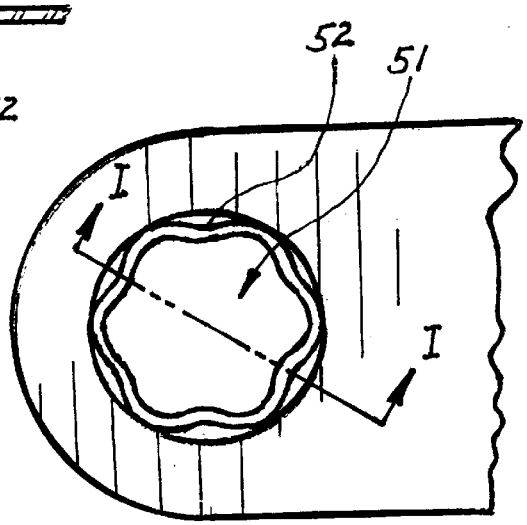
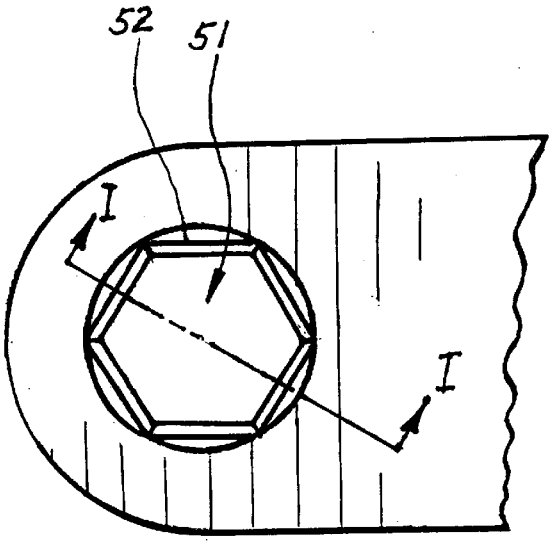
FIG. 16
FIG. 17
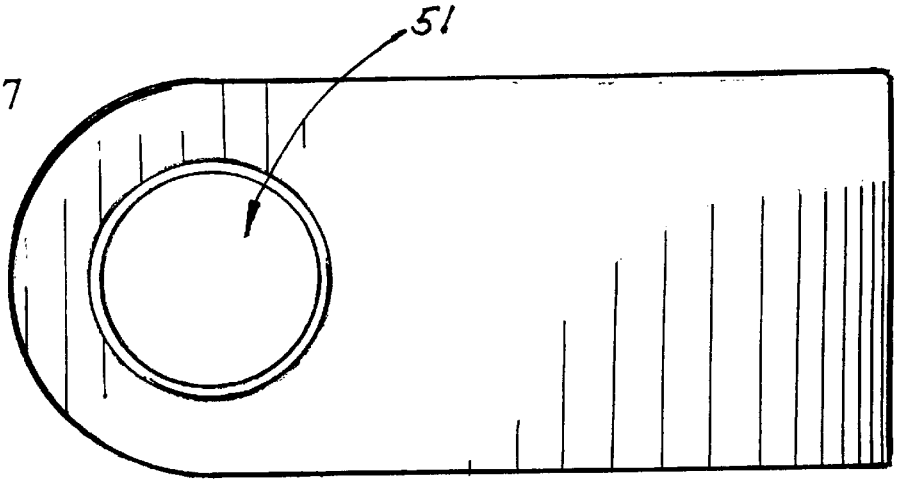

GOLF BALL MARKING TEMPLATE

FIELD OF THE INVENTION

The present invention relates to the field of sports ball identification devices. More specifically, the present invention relates to the field of devices designed to mark or otherwise identify golf balls.

BACKGROUND

While playing golf, it is not uncommon for several different individuals on the course to be playing with the same make of golf ball. This leads to the possibility of misidentifying.

One of the problems commonly encountered while playing golf is the identification of ball in games to the player or side owning them. This is especially acute when many players in the same course use the same make of ball. Thus it would be useful to create a device that would eliminate disputes and disagreements and unnecessary acrimony during the progress of a game. This also encourages diligence and honesty in caddies and others searching for balls and enable them to reach the real owners of the found balls and be properly rewarded.

There are devices that forcibly imprint a mark within the surface of the golf ball, however, this marring of the surface affects the flight and life-span of the ball. Other devices are complex mechanical devices that provide for a single type of mark on the ball. Further, those devices that provide for different marks typically require the user to change stamps or marking dies.

Thus, there is a need for a simple device that allows a golf ball to be marked with large mark. Further, there is a need for a device that allows a user to make a variety of different marks on the golf ball without resorting to complex interchanging of parts or the like.

SUMMARY OF THE INVENTION

It is an object of the present invention to provide a device that aids in the marking of balls, such as golf balls.

It is another object of the present invention to provide a device that comprises substantially two halves for the marking of golf balls.

It is a further object of the present invention to provide a golf ball marking template that allows one to mark a golf ball with a generally baseball stitching type marking, thereby providing a marking that is clearly visible without the need of moving a sitting golf ball.

It is yet a further object of the present invention to provide a generally integral baseball stitching-type marking template.

It is yet another object of the present invention to provide a two piece baseball stitching type marking template, the two pieces attached to each other by a pin and barrel type hinge mechanism.

It is still a further object of the present invention to provide a golf ball marking template that has two halves, each with a shaped aperture that provides the outline for marking the golf ball.

It is still yet another object of the present invention to provide a ball marking template comprising first and second portions attached to each other by a curved portion, each of the first and second portions having a shaped aperture located at a distal end, respectively, whereby when a golf ball is placed within the template, it may be marked by tracing along a peripheral edge of the apertures.

It is another object of the present invention to provide a ball marking template comprising first and second portions attached to each other at first ends respectively by a hinge mechanism, the first and second portions both have a concave inner face and each further having a peripheral edge, whereby when a golf ball is placed within the template, it may be marked by tracing along the peripheral edge of the first and second portions.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of different embodiments, including the preferred embodiment, of the present invention when read in conjunction with the accompanying drawings wherein:

FIG. 5 illustrates the use of another embodiment of the present invention, one with a pin barrel type hinge mechanism;

FIG. 6 is a side view of the another embodiment of the present invention in an open position, ready to accept a golf ball to be marked, the golf ball is illustrated with a dotted line;

FIG. 7 is a side view of the another embodiment of the present invention in a closed position, securely holding a golf ball to be marked;

FIG. 8 is an exploded view of the another embodiment clearly showing the two parts, one with an oversized pin, the other with a partial barrel;

FIG. 9 illustrates how the pin and partial barrel of the two halves of the another embodiment fit together to form the hinge mechanism;

FIG. 14 shows how the apertures in the yet another embodiment of the present invention may be formed with flanges to more securely receive a golf ball to be marked;

FIGS. 15, 16, and 17 illustrate several different shapes for the apertures in the yet another embodiment of the present invention, each providing a distinctively different marking outline on a golf ball;

DESCRIPTION OF PREFERRED EMBODIMENTS

Figure 1:
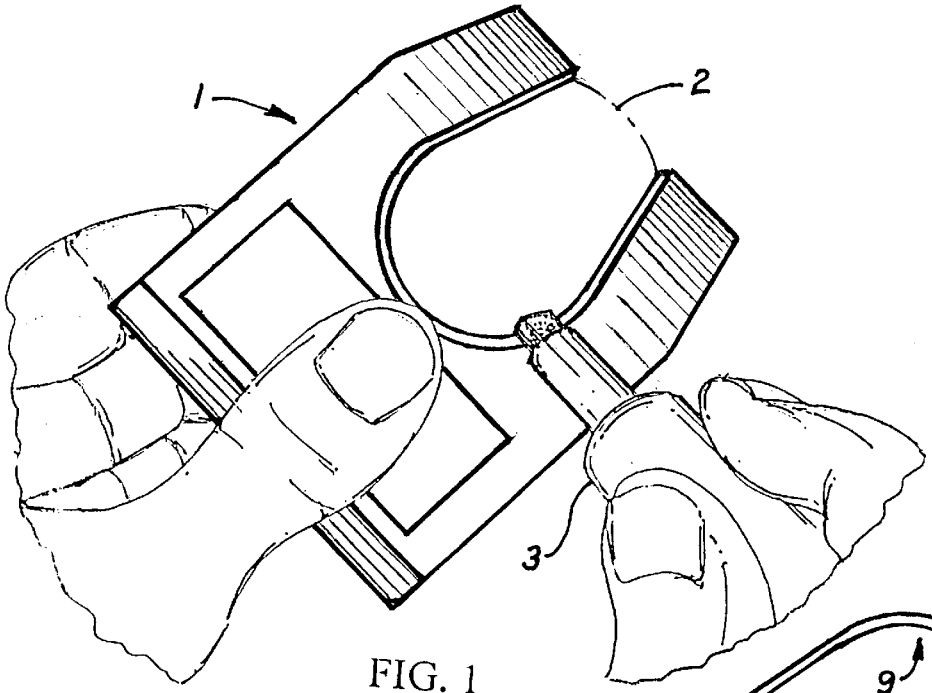
FIG. 1 illustrates the use of one embodiment of the present invention.
Figure 2:
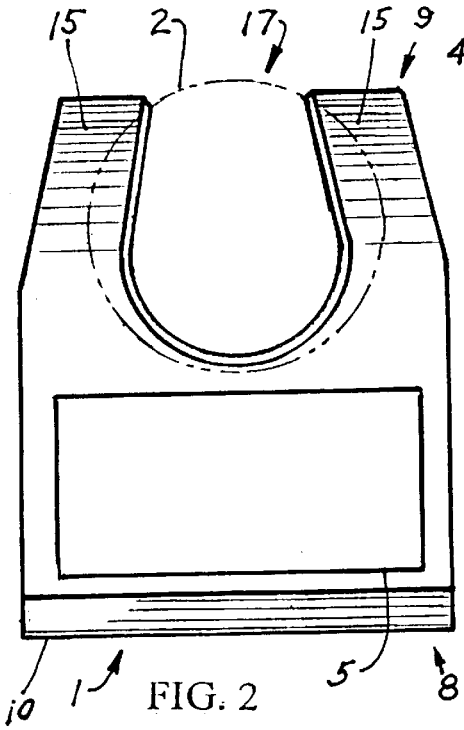
FIG. 2 is a top view of the one embodiment of the present invention.
Figure 3:
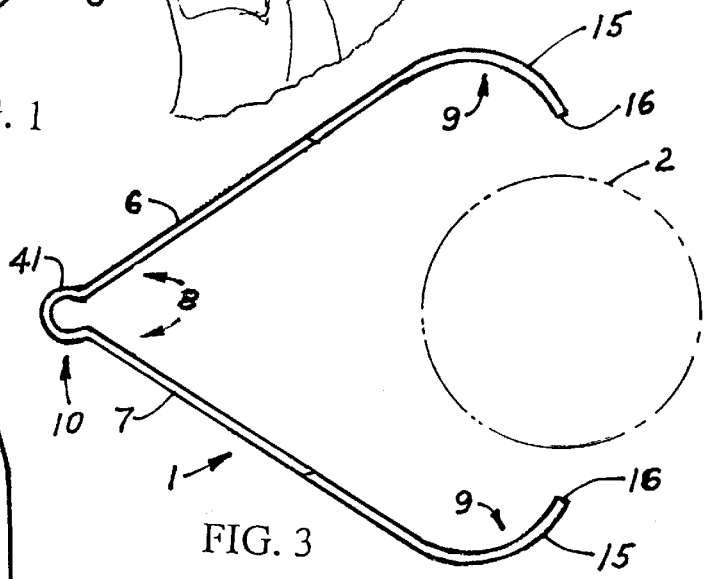
FIG. 3 is a side view of the one embodiment of the present invention in an open position, ready to accept a golf ball to be marked, the golf ball is illustrated with a dotted line.
Figure 4:
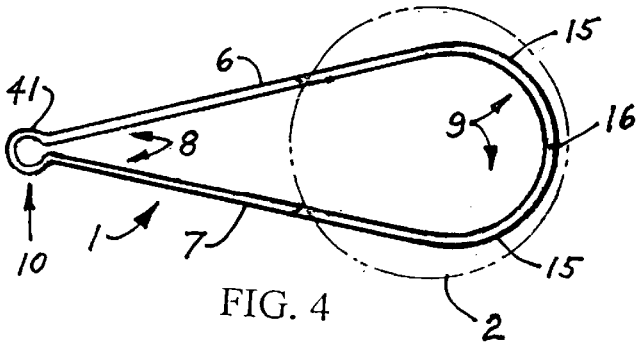
FIG. 4 is a side view of the one embodiment of the present invention in a closed position, securely holding a golf ball to be marked.
Figure 10:
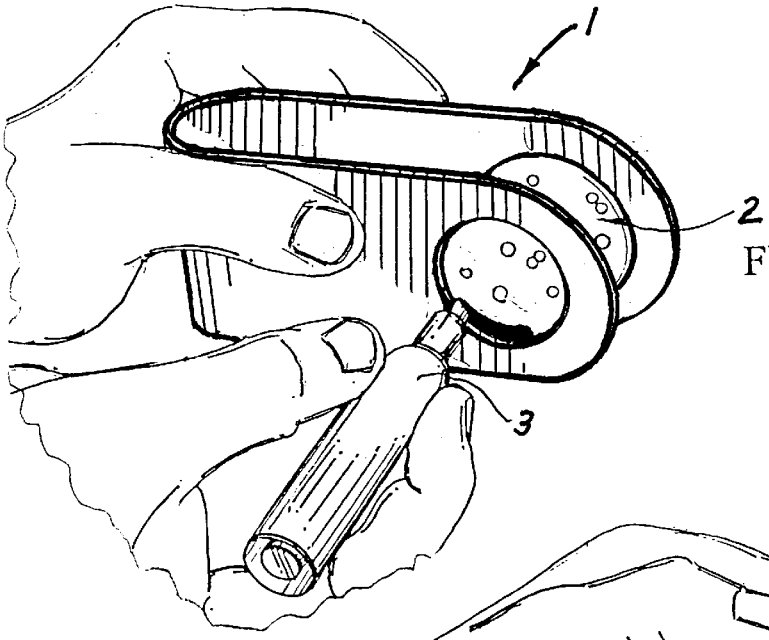
FIGS. 10 and 11 illustrate how yet another embodiment of the present invention receive and securely hold a golf ball to be marked.
Figure 11:
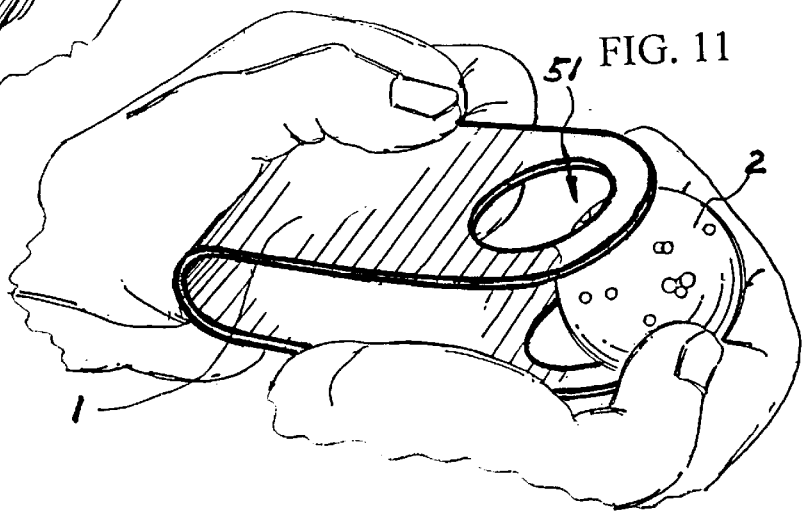
Figure 12:
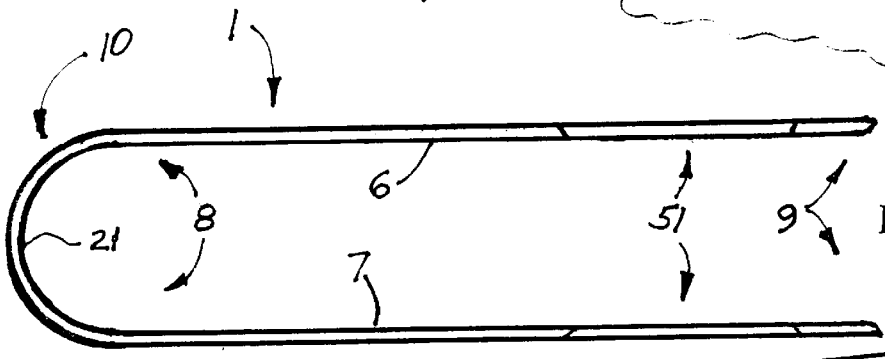
FIG. 12 is a side view of the yet another embodiment of the present invention.
Figure 13:
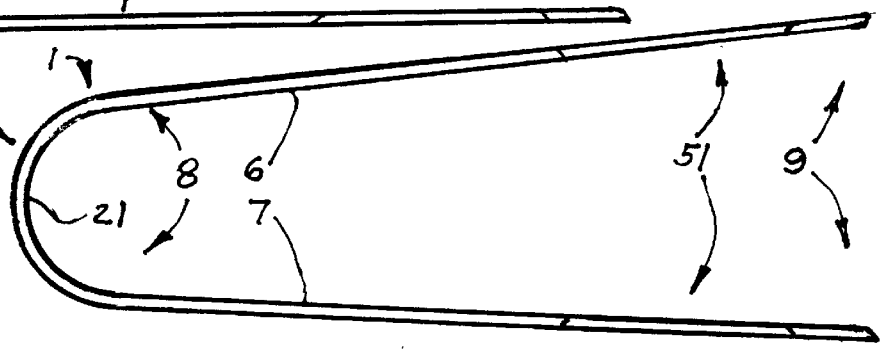
FIG. 13 shows how the yet another embodiment may be opened wide enough to receive a golf ball for marking.
Figure 18:
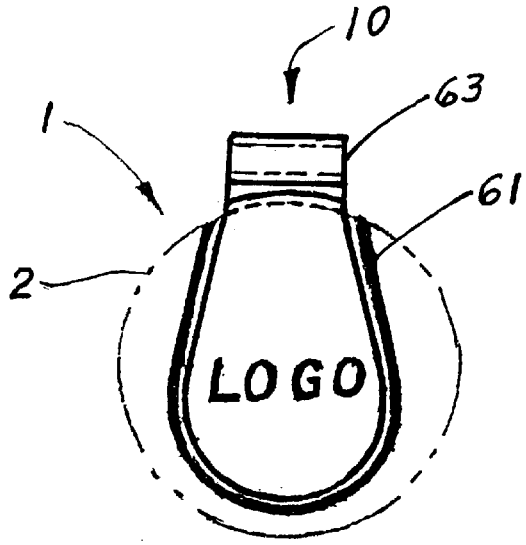
FIG. 18 is a view of still yet another embodiment of the present invention.
Figure 19:
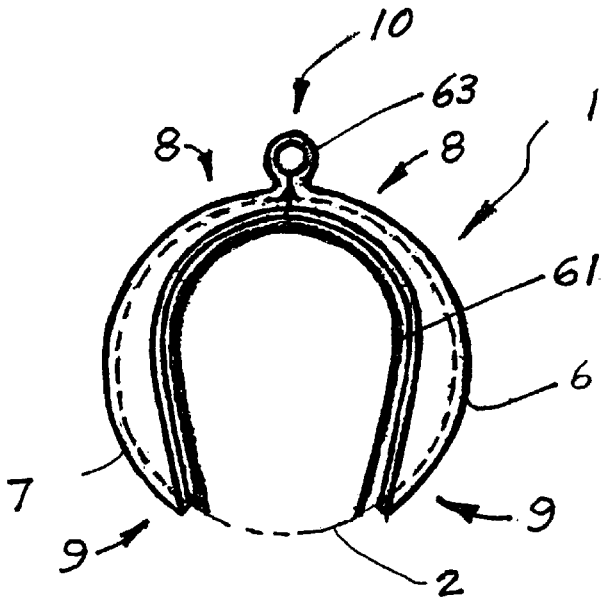
FIG. 19 is another view of the still yet another embodiment rotated by 90 degrees.
Figure 20:
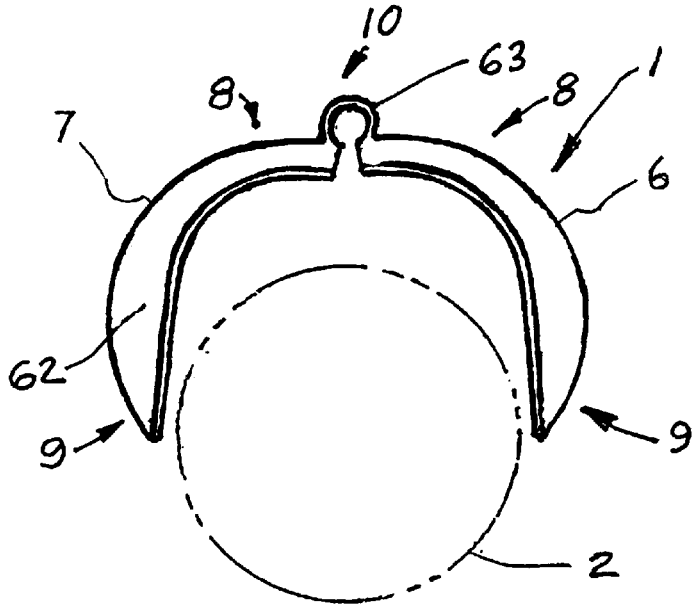
FIG. 20 illustrates how the still yet another embodiment opens to receive a golf ball to be marked by the present invention.
Figure 21:
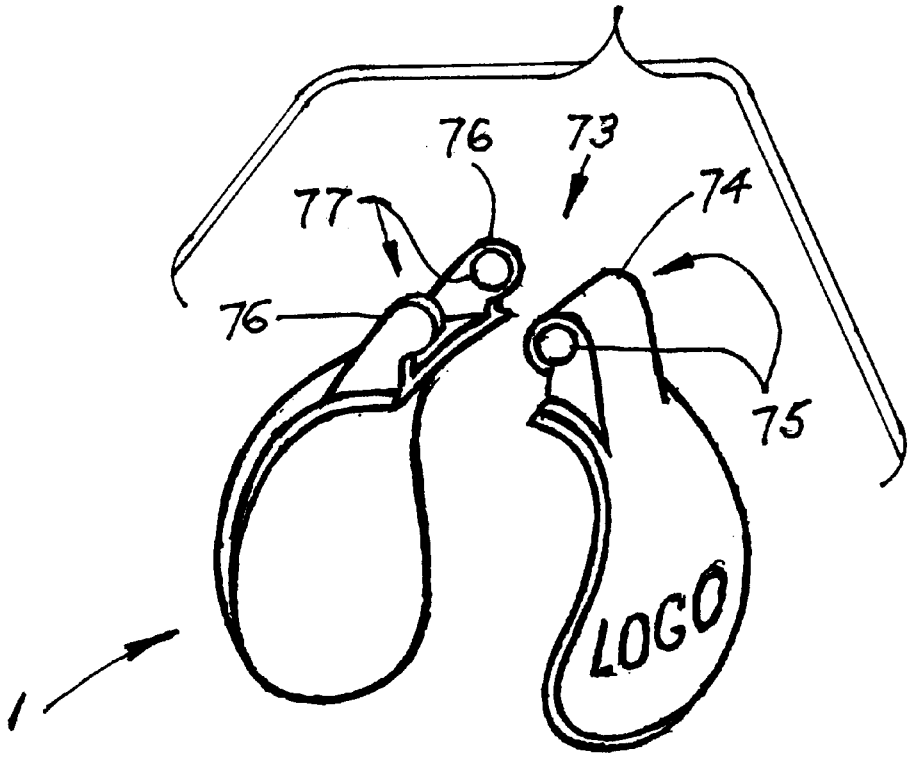
FIG. 21 is an exploded view of the still yet another embodiment, clearly illustrating a pivot pin hinge mechanism.
Figure 22:
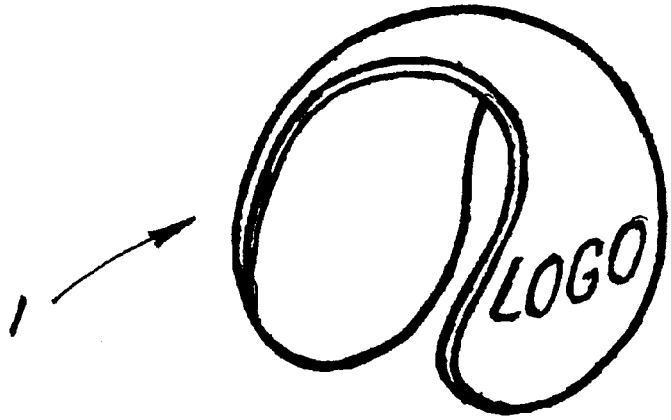
FIG. 22 is a further embodiment with an integral form and integral resilient hinge mechanism.
Figure 23:
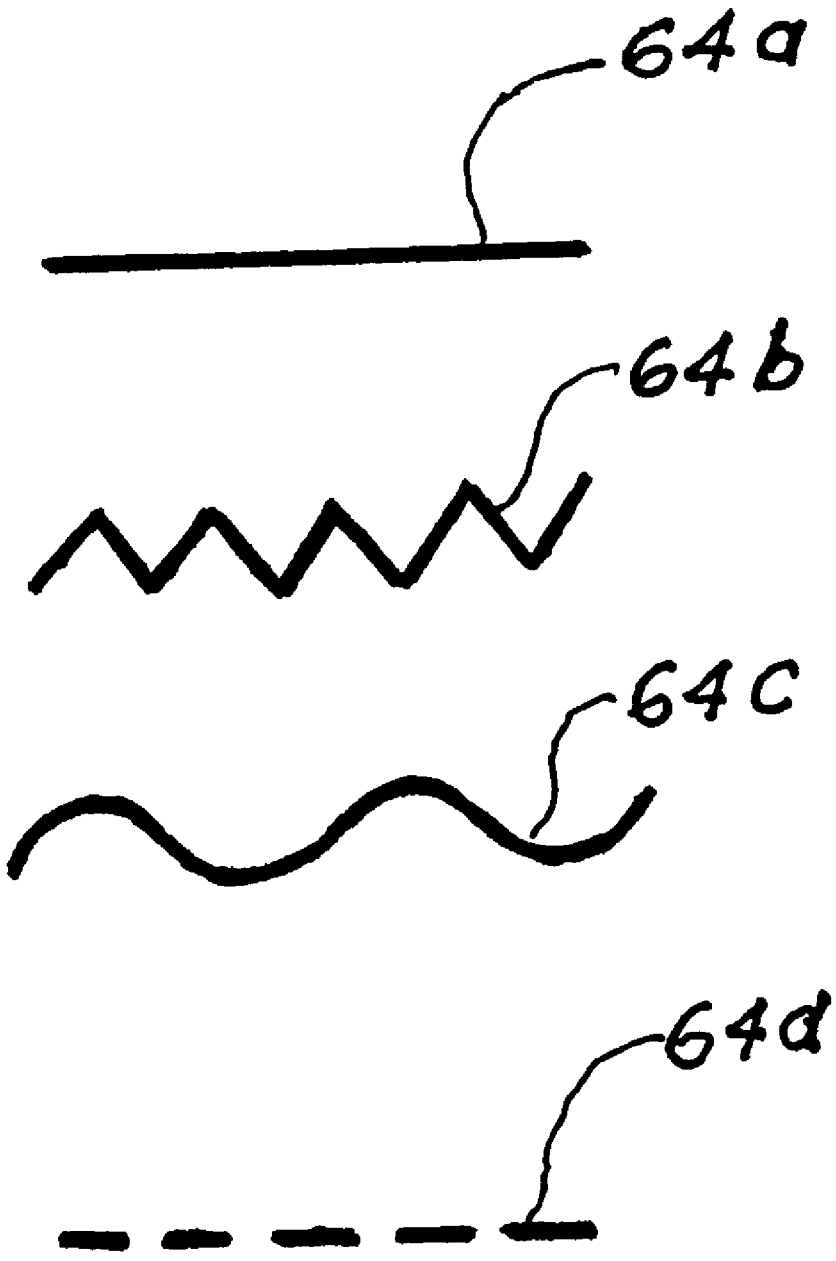
FIG. 23 illustrates four types of traces that may be produced by modifying the surface of either the inner periphery of the first embodiments, or the outer periphery of the latter embodiments.

The present invention is a generally U-shaped or V-shaped device 1 that is used primarily as a template for marking golf balls 2. A golf ball 2 is placed into the device 1, or template, and the user takes a separate marker 3, such as an indelible ink pen, and traces a predetermined pattern on the outside surface of the golf ball 2. The then marked golf ball 2 is then removed from the template 1, after having been marked, and used in a game of golf. One of the primary advantages of the template according to the present invention is that the marks placed upon the golf ball 2 may be easily seen from almost any angle. Therefore, the user does not have to move, or lift, the golf ball 2 in order to identify it.

In one embodiment of the present invention, the template 1 comprises a body 5 that has two major portions, a first portion 6, and a second portion 7. Each of the first and second portions 6 and 7 has a first end 8 and a second end 9. Preferably, both portions 6 and 7 have small thickness', relative to their width and length.

The first and second portions 6 and 7 are attached to each other at their first ends 8, respectively, by a hinge mechanism 10. At the second end 9 of each portion 6 and 7, located at opposite sides thereof, are two arms 15.

The hinging mechanism 10 allows a golf ball 2 to be placed between the two portions 6 and 7, which are then pressed toward each other thereby securing or holding the golf ball 2 in a position to be marked. In one embodiment, the hinge mechanism 10 is merely a curved piece 21 of the same material that the first and second portions 6 and 7 are made from. Pressure provided by the user forces the two portions 6 and 7 together. The natural resiliency of the material of the hinge mechanism 10 provides a spring type biasing that, when the user releases pressure, separates the two portions 6 and 7.

In another embodiment, the hinge mechanism 10 is pin 31 with a partial barrel 33. The pin 31 is a cylindrical portion 32 that is located at the first end 8 of one of the first or second portions, 6 or 7. The cylinder 32 is attached along one side such that lies in line with what for purposes of this patent will be defines as the width direction of the template 1. The pin 31 may be solid, or as seen in the figures, it may be a hollow cylinder. The remaining first or second portion, 6 or 7, has the partial barrel 33 attached, also along the width direction. The barrel 33 has an opening 34 that is capable of receiving the pin 31. It is critical that the opening 34 in the barrel 33 not be more than one half the circumference of the barrel outline, otherwise the barrel 33 would not remain on the pin 31 when the pin 31 is inserted into the barrel 33. Likewise the barrel 33 must be large enough that insertion of the pin 31 into the barrel 33 would not irreversibly deform the barrel 33. The preferred size of this opening 34 is dependent upon the physical characteristics of the materials being used. For example, a plastic material would be more yielding than a metallic material. Thus the opening 34 in a device 1 made from plastic could be smaller, but not necessarily so, than the opening 34 for a device 1 made from a metallic material. There may be caps 35 located at each end of the pin 31 that are used to prevent the barrel 33 from longitudinal movement that would result in the accidental disassembly of the device 1.

In yet another embodiment, and most preferred embodiment, the hinge mechanism 10 is a living hinge 41 of the type commonly used in plastic box application. As illustrated in the figures, in this embodiment, the hinge mechanism 10 comprises a narrowing, or thinning, of the materials used to attach the first and second portions, 6 and 7, together. One method of manufacturing this embodiment the entire device 1 is molded as a single unit. The hinge area 10 is molded as being thinner than that of the first and second portions, 6 and 7. Another method is to extrude the device 1, where the hinge mechanism 10 portion of the extrusion die form a thinner cross section than that of the first and second portions, 6 and 7.

Both of the arms 15 on each of the first and second portions, 6 and 7, are curved in an inward direction. For purposes of this patent, the term, or direction, inward means toward a hypothetical plane that splits the device 1 into two generally equal halves, each of the two portion, 6 And 7, are on a separate side of this hypothetical plane, respectively. When looking at a portion, 6 or 7, along the length and width place, the arms 15 gradually curve toward perpendicularity with the length and width plane. This curve may have constant radius of curvature, it may have a constantly changing radius of curvature, or it may have a combination of the two. Further, the curve of the arms 15 must be such that when a golf ball 2 is placed within the device 1 and the first and second portions, 6 and 7, are forced together, the golf ball 2 is held securely and distal tips 16 of the arms 15 meet substantially together.

There is a gap 17 between the arms 15 that forms the outline that is followed by a separate pen 3 to create the mark on the golf ball 2. The shape, or outline, of the gap 17 is variable, but should be of a shape and size to create a mark that, at least a portion of which can be easily seen without resorting to lifting the golf ball 2. One of the most preferred shapes for the gap 17, according to the present invention is a substantially U- or horseshoe like shape 18. In this most preferred shape, the distance between distal ends 16 of the arms 15, or legs of the U or horseshoe shape 18, are closer together than more proximate ends closer to the radius of curvature of the U-shape 18. When a golf ball 2 is placed into the template 1 and this most preferred shape is traced with a pen 3, a marking is produced that greatly resembles that of the stitching of a baseball. This shape is continuous and a portion of it can be easily seen without resorting to moving the golf ball 2.

In still yet another embodiment, the first and second portions, 6 and 7, do not have arms 15 that curve inward, but instead, are generally flat and longer than the above described embodiments. There is a large aperture 51 located near the second end 9 of each of the first and second portions, 6 and 7, that is sized to accommodate holding a golf ball 2. The two apertures 51 of the first and second portions, 6 and 7, are generally lined up, or coaxial. Thus, a golf ball 2 is inserted into the template 1, between the two apertures 51, and the first and second portions, 6 and 7, are forced together, the golf ball 2 is held securely in the two apertures 51, between the first and second portions, 6 and 7. A pen 3, or maker, may then be used to trace the outline of each of the apertures 51, thereby marking the golf ball 2 with two large designs, such as a circle, a hexagon, a flourish or scallop, or the like. These designs should be located between the largest circumference of the golf ball 2, or its equator, and the points of the golf ball 2 that are coaxial with that equator, or poles. Preferably, they will be located approximately halfway between the equator and the poles of the golf ball 2. This location is felt to be the optimum location of two designs that minimizes the need to move the golf ball 2 to see any markings. Furthermore, edges 52, or flanges, of the apertures 51 may be raised outwards to more closely accommodate securely holding the golf ball 2.

In yet another embodiment, the device 1 is comprised of two portions, 6 and 7, that are attached by the hinge mechanism 10. However, in this embodiment, the two portions 6 and 7, do not have arms 15 or apertures 51. Instead, the periphery 61 of the portions, 6 and 7, provide the outline for the marking. Thus, in this embodiment, the portions, 6 and 7, appear as negative images of the portions, 6 and 7, described in the previous embodiments. Therefore, the peripheral outline 61 of the portions, 6 and 7, are in a most preferred embodiment, are substantially U-shaped, or horse shoe shaped. Contrary to the previously described U-shape in one of the above described embodiments, the curved portion of the U-shape is at the distal, or second, end 9 of the portions, 6 and 7, and is wider than the proximate, or first, end 8. This substantially U-shape of the two portions, 6 and 7, when traced onto a golf ball, provide a marking that is substantially similar to that of the stitching found on a baseball.

In the presently described embodiment the portions are not flat but have concave inner surfaces 62 that firmly and conveniently hold a golf ball 2. The curvature of the concave inner surface 62 substantially matches that of an ordinary golf ball 2. Furthermore, the two portions, 6 and 7, may have alternate shapes for the peripheral outlines 61 that provide a variety of different shaped marks that can be traced onto a golf ball 2. The peripheral outline 61, for all the above described embodiments, also does not necessarily have a smooth and continuous trace 64*a,* but may be jagged, with a zigzag type trace 64*b;* it may be curvy, or wavy trace 64*c;* it may provide a dotted line type trace 64*d,* or other like traces.

As described above, the two portions, 6 and 7, are attached at first ends 8, respectively, by the hinge mechanism 10. This hinge mechanism may be a living hinge 63; it may be a pivot pin assembly 73 with a central barrel 74 with pins 75, or convex end surfaces, attached to one portion, 6 or 7, and two outer caps 76 with concave inner surfaces 77, or indents, attached to the remaining portion, 6 or 7; it may be a generally flexible curved surface that is integrally formed with the two portions, 6 and 7, or the like.

Finally, in all of the above embodiments, logos or other advertising media may be placed on an outer surface of at least one of the two portions, 6 and 7, to provide advertising and sales opportunities for either a user or one who uses golfing activities for promotions.

While these descriptions directly describe the above embodiments, it is understood that those skilled in the art may conceive modifications and/or variations to the specific embodiments shown and described herein. Any such modifications or variations that fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A golf ball marking template for securing a golf ball for marking and for providing a marking pattern for the golf ball comprising:

a generally U-shaped resilient member adapted to secure a golf ball therebetween, said U-shaped resilient member having a first portion, a second portion and a hinge mechanism, said first and second portion each having a concave inner surface for holding a golf ball, each of said first and second portions also having a first end and a second end and being attached to each other at their first ends by said hinge mechanism; and a peripheral U-shaped edge being provided at the second end of each portion, whereby when the golf ball is placed within the template and held between the first and second portions, the golf ball can be marked by tracing along the peripheral edge of each portion with a pen or marker.

2. The ball marking template according to claim 1 wherein the hinge mechanism is a living hinge.

3. The ball marking template according to claim 2 wherein the peripheral edges of the first and second portions provide a generally baseball type stitching outline that, when used in marking the golf ball, provide a generally baseball type stitching mark.

4. The ball marking template according to claim 1 wherein the hinge mechanism is a pivot pin assembly.

5. The ball marking template according to claim 4 wherein the pivot pin assembly further comprises a central barrel with pins, attached to one of the first and second portions, and two indents, attached to the other of the first and second portions.

6. The ball marking template according to claim 5 wherein the peripheral edges of the first and second portions provide a generally baseball type stitching outline that, when used in marking the golf ball, provide a generally baseball type stitching mark.

7. The ball marking template according to claim 1 wherein the hinge mechanism is a substantially curved piece of resiliently flexible material, where the flexibility of the material provide the ability of the two portions to be moved apart when inserting the golf ball.

8. The ball marking template according to claim 7 wherein the hinge mechanism is integrally formed with the first and second portions.

9. A golf ball marking template for securing a golf ball for marking and for providing a marking pattern for the golf ball comprising:

a generally U-shaped resilient member adapted to secure a golf ball therebetween, said U-shaped member having a flat first portion, a flat second portion and a hinge mechanism, said first and second portion each having a first end and a second end and being attached to each other at their first ends by said hinge mechanism;

a shaped aperture completely contained within each second end of said first and second portions, said apertures being sized to accommodate a golf ball, wherein each aperture has a raised edge for securely holding the golf ball; and whereby when a golf ball is placed within the template between the two apertures and the first and second portions are forced together, the golf ball may be marked by tracing along a peripheral edge of each of the apertures with a pen or marker.

10. The ball marking template according to claim 9 wherein the shape of the aperture is selected from the group consisting of a circle, a hexagon, and a scallop.

* * * * *